United States Patent [19]

Friend et al.

[11] 4,257,305

[45] Mar. 24, 1981

[54] PRESSURE SENSITIVE CONTROLLER FOR ELECTRONIC MUSICAL INSTRUMENTS

[75] Inventors: David Friend, Boston; Royce C. Kahler, Jr., Weston, both of Mass.

[73] Assignee: ARP Instruments, Inc., Lexington, Mass.

[21] Appl. No.: 863,874

[22] Filed: Dec. 23, 1977

[51] Int. Cl.[3] ..... G10H 1/02

[52] U.S. Cl. ..... 84/1.24; 84/DIG. 7; 338/69; 338/96; 338/114; 338/47

[58] Field of Search ..... 84/1.1, 1.24, DIG. 7, 84/1.01, DIG. 8; 340/365 E; 338/47, 69, 96, 114

[56] References Cited

U.S. PATENT DOCUMENTS

| | | | |
|---|---|---|---|
| 2,134,323 | 10/1938 | Beach | 201/55 |
| 3,328,507 | 6/1967 | Peterson | 84/1.1 |
| 3,609,201 | 9/1971 | Adachi | 84/1.01 |
| 3,609,203 | 9/1971 | Adachi | 84/1.01 |
| 3,902,392 | 9/1975 | Nagahama | 84/1.01 |
| 3,965,789 | 6/1976 | Pearlman | 84/DIG. 7 |
| 3,968,467 | 7/1976 | Lampen et al. | 338/69 |
| 3,991,646 | 11/1976 | Kakehashi | 84/1.01 |
| 4,023,455 | 5/1977 | Peterson | 84/DIG. 8 |
| 4044,643 | 8/1977 | Chase | 84/DIG. 8 |
| 4,079,651 | 3/1978 | Matsui | 84/1.1 |
| 4,085,647 | 4/1978 | Adachi | 84/1.01 |
| 4,120,226 | 10/1978 | Finch | 84/DIG. 8 |
| 4,136,595 | 1/1979 | Gillette | 84/DIG. 8 |

OTHER PUBLICATIONS

J. Simonton, "Portable Mini Organ," Radio-Electronics, Jan. 1977, pp. 31-34.

*Primary Examiner*—J. V. Truhe
*Assistant Examiner*—Forester W. Isen
*Attorney, Agent, or Firm*—Cesari and McKenna

[57] ABSTRACT

An electronic musical instrument incorporates one or more pressure sensitive push-button controllers actuable independent of the keys or other note selecting elements of the instrument to vary a corresponding number of musical parameters. The specific controllers provide a sensitive, smooth, repeatable parameter variation in response to both the location and the force of the player's touch.

8 Claims, 10 Drawing Figures

PRESSURE SENSITIVE CONTROLLER FOR ELECTRONIC MUSICAL INSTRUMENTS

BACKGROUND OF THE INVENTION

A. Field of the Invention

The invention relates to electronic musical instruments, and comprises a musical instrument having one or more pressure sensitive transducers thereon actuable independently of the note selecting elements for varying a corresponding plurality of selected musical parameters (such as pitch, vibrato, etc.) in response to a player's touch. The invention also includes a unique pressure sensitive transducer especially suited to this purpose.

B. Prior Art

Transducers convert one physical parameter into another. Electromechanical transducers convert an electrical quantity into a mechanical quantity or vice versa. For example, a transducer may convert a mechanical quantity, such as force, into an electrical quantity, such as voltage or current.

One type of transducer that is useful in electronic musical instruments is shown in U.S. Pat. No. 3,784,935, issued Jan. 8, 1974, to Alan R. Pearlman and Dennis P. Colin and assigned to the assignee of the present invention. The transducer illustrated there is an electromechanical transducer of the pressure-sensitive type, that is, an output voltage is produced that is a function of the pressure applied to the transducer by the player. One such transducer is associated with each playing element (key) and thus a large number of transducers are used for each keyboard. Further, the point of application of the pressure on such transducer is fixed and a selectively variable sensitivity is not obtainable.

A strictly position-sensitive transducer has heretofore been used on keyboard instruments, but this again limits the "touch sensitivity" provided to a player, and generally requires visual observation during actuation; it is thus distracting to the player.

OBJECTS OF THE INVENTION

Accordingly, it is an object of the invention to provide a musical instrument having a tactily sensitive control board independent of the note selecting elements of the instrument for controlling a selected number of musical parameters of the instrument.

Further, it is an object of the invention to provide a musical instrument having a compact control board which provides a controllably sensitive response to a player's touch for controlling selected musical parameters of the instrument.

Another object of the invention is to provide an improved pressure sensitive transitive transducer for an electronic musical instrument.

Yet another object of the invention is to provide a pressure sensitive transducer for an electronic musical instrument that creates a smooth and continuous output variation in response to variations in the input.

A further object of the invention is to provide a pressure sensitive transducer for an electronic musical instrument that is simply and economically constructed.

Yet another object of the invention is to provide a pressure sensitive transducer for an electronic musical instrument that provides a sensitive "touch" to a player.

BRIEF DESCRIPTION OF THE INVENTION

In accordance with the present invention, a musical instrument is provided with a pressure-sensitive push button controller comprising one or more pressure-sensitive pads for controlling a corresponding number of musical parameters such as pitch, vibrato, etc. Each pad is in the form of an elevated planar surface bounded by side ridges to facilitate location of a player's finger thereon and deformable in response to pressure exerted through a player's finger to vary an electrical parameter of a circuit associated with the instrument and thereby vary a musical parameter of the instrument. The response of a pad to pressure applied at a given location on the pad is a function of the applied pressure up to the "maximum effective" pressure for that location and this pressure varies from location to location on the pad. Thus each pad effectively provides a variable sensitivity to touch. The dimensions of each pad are suitably limited (e.g. one inch in length, one-half inch in width) so as to facilitate accurate location of a player's finger thereon, while allowing a wide range of parameter variability due to its pressure responsive characteristics.

In accordance with a preferred embodiment of the invention, the undersurface of the pad carries an elongated electrical conductance or "shorting" element in electrical circuit with a fixed electrical contact and mounted to oppose a correspondingly elongated resistance element that is spaced from the fixed contact. First and second terminals are formed at the fixed contact and at the remote end (the end farthest from the fixed contact) of the resistance element. In response to pressure on the frontal surface of the pad, the shorting element is brought into contact with the resistance element and thereby spans the gap between this element and the fixed contact to diminish the resistance measured between the first and second terminals.

The undersurface of the pad is curved and is mounted such that it, and thus the shorting element carried on it, curves away from the resistance element, beginning at the near end of the element (the end nearest the fixed contact). As pressure is applied to the pad, an increasing area of contact is made between the shorting element and the resistance element. The contact area is determined by the amount of pressure applied and the location of its application. As long as the pressure is maintained, those areas of the shorting element which have come into contact with the resistance element during application of the pressure remain in contact with it.

Since full pressure by a player is applied not instantaneously but only over a finite (albeit short) time interval, the "leading edge" of the shorting element (i.e., the end most remote from the fixed contact that just contacts the resistance element) progressively "rolls" along the shorting element as the pressure increases during application. This provides a response whose sensitivity is a function of the applied pressure (up to the maximum) and the location of that pressure. It also provides a smoothly varying response, since the response does not jump from an initial to a final value instantaneously but rather smoothly progresses between the two; this is a quality that is highly desirable in musical instruments. The reverse effect takes place on release of the pressure, that is, a smoothly decreasing "rolling" contact area results in a smooth return to initial conditions.

In addition to serving as a switch contact, the fixed contact is constructed so as to provide a precisely defined, initial spacing between the contact strip and the resistance element in the absence of external force on the housing. This enables the contact strip and the resistance element to be mounted very close to each other so as to insure that even a slight force on the housing will bring the two into contact and thereby complete the control circuit, while assuring that the elements are held apart in the absence of any such force. This is especially significant from a production point of view, since normal production tolerances would ordinarily require that the contact strip and the resistance strip be spaced apart from each other much farther so as to insure the zero-pressure open circuit state under all conditions, even at tolerance extremes.

The fixed contact and the resistance element are advantageously formed on the surface of a printed circuit board. Further elements associated with the control circuit may also be connected to this board. The result is a highly economical, mechanically sound package that is simple and economical to construct and that provides ready accessibility for testing, repair and replacement.

Further in accordance with the present invention, the variable resistance presented between the terminals as described above is connected in series with a fixed resistance to form a voltage dividing circuit to which a pilot signal, which may comprise an ac signal, a dc signal, or a combination of both, is applied. The output signal taken across from one of these resistances is applied to one or more diodes prior to its utilization as a control signal. These diodes further smooth the response of the controller and allow the use of a more convenient range of resistance values than would otherwise be the case. Importantly, they compensate for the initial discontinuity that occurs when the resistence between the output terminals changes from its initial open circuit (infinite resistance) value to a closed circuit value of finite resistance. In the absence of such diodes, actuation of the controller by applying pressure to it would result in an initial small but sudden jump in output on contact closure, followed by a smooth transition to the final output value. The diodes effectively eliminate the initial sudden jump in output on circuit closure.

DETAILED DESCRIPTION OF THE INVENTION

The foregoing and other and further objects and features of the invention will be more readily understood on reference to the following detailed description of the invention when taken in conjunction with the accompanying drawings in which.

Figure 3:
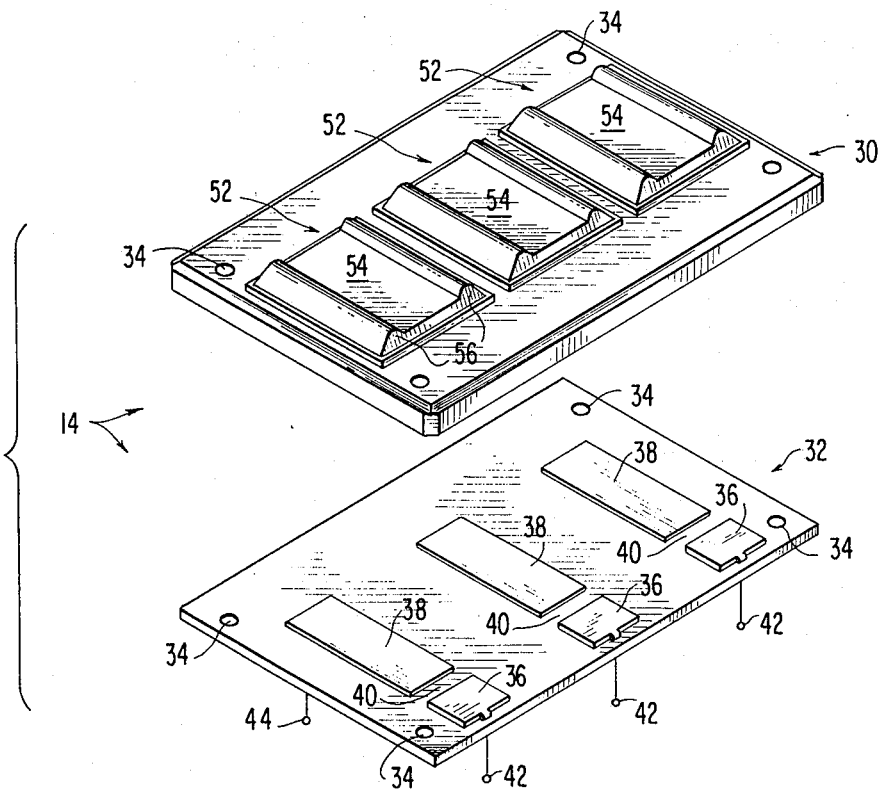
FIG. 3 is an exploded view in perspective of a preferred form of controller in accordance with the present invention.
Figure 4:
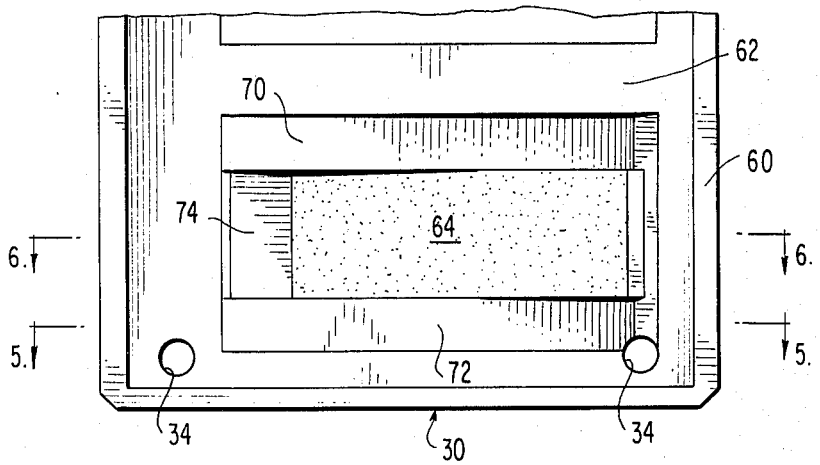
FIG. 4 is a bottom plan view of the controller pad of FIG. 3.
Figure 5:
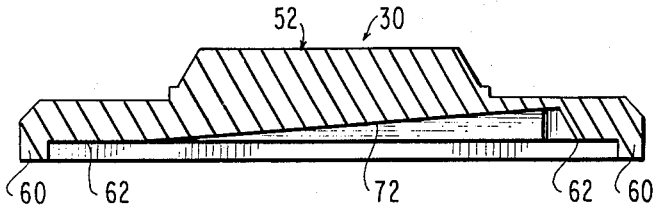
Figure 6:
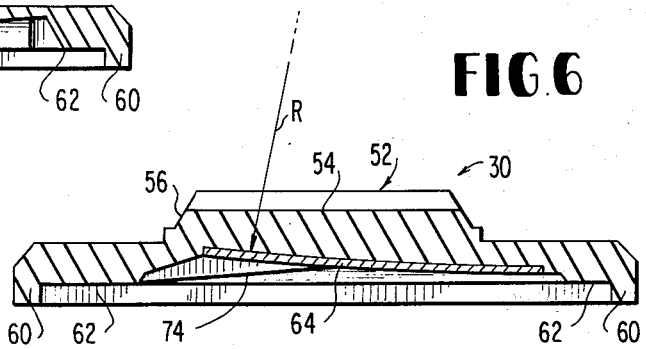
Figure 7:
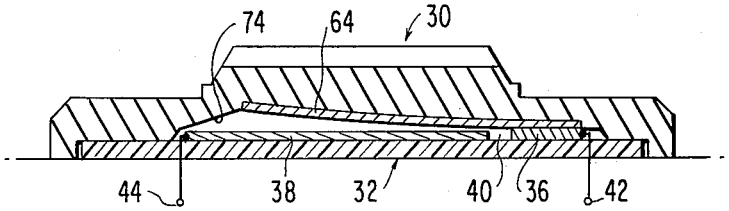
Figure 8:
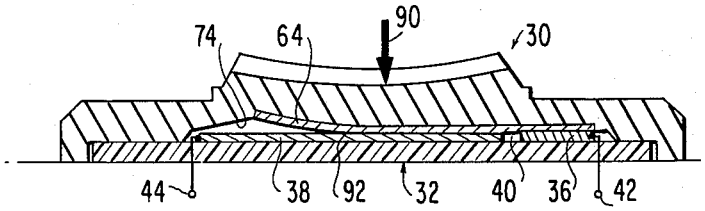
Figure 9:
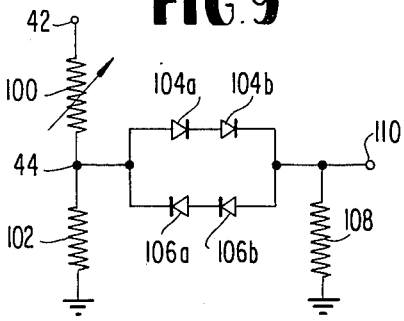
Figure 10:
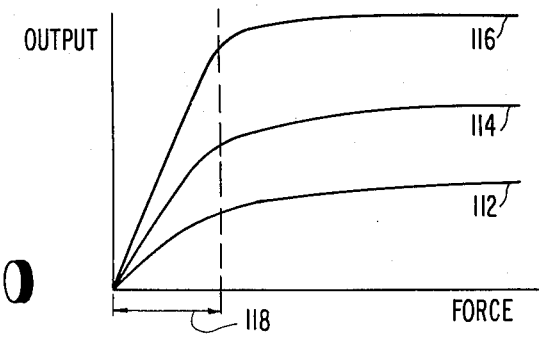

FIG. 5 and 6 are vertical section views along the lines 5—5 and 6—6 of FIG. 4, respectively;

FIG. 7 is a vertical sectional view of the assembled structure taken along the lines 7—7 as indicated in FIG. 3;

FIG. 8 is a schematic illustration of the resistence and contact elements of the structure of FIG. 3 through 7;

FIG. 9 is a circuit diagram of the controller circuit in accordance with the present invention and FIG. 10 is a diagram illustrating the response of the controller to pressure and to its point of application.

Figure 1:
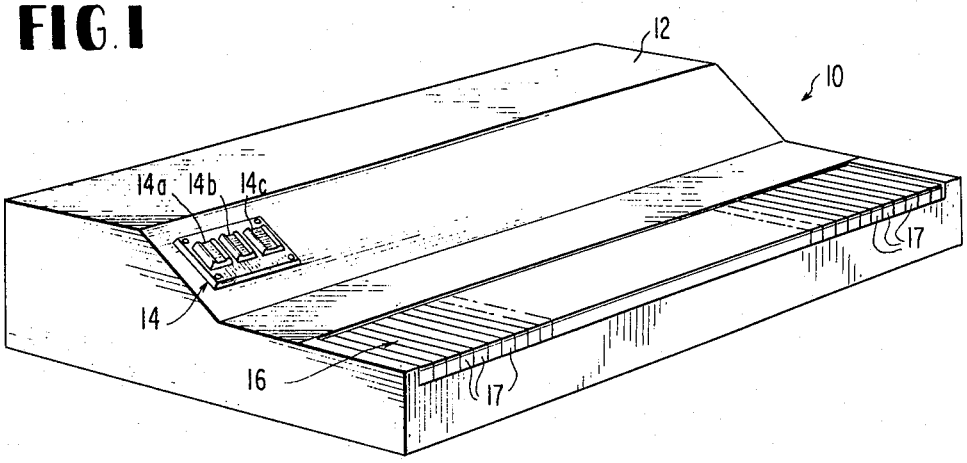
FIG. 1 is a view in perspective of a electronic musical instrument incorporating a control board comprising a plurality of pressure-sensitive actuable controllers independently of the note-selecting elements of the instrument in accordance with the present invention.
Figure 2:
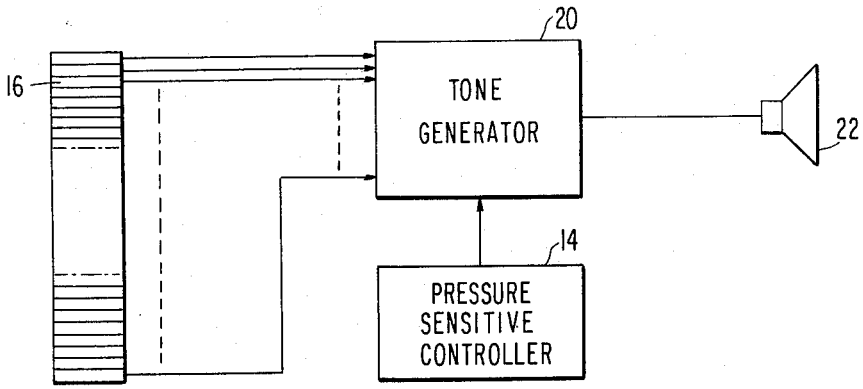
FIG. 2 is a block and line diagram schematically illustrating the operation of the control board of FIG. 1.

In FIG. 1, an electronic musical instrument 10 comprises a housing 12 on which is mounted controller 14 in accordance with the present invention; for the purpose of illustration, the instrument 10 is represented as a keyboard instrument having a plurality of individually playable keys 16. Contained within the housing 12, and not shown in FIG. 1, are signal processing circuits which respond to actuation of the controller 14 or keys 16 to provide the desired musical signals. For example, the instrument 10 may be constructed such that playing any one of the keys 16 produces a musical note corresponding to that which would be produced by a piano or other musical instrument. The controller 14 modifies the effects produced by playing the key 16. This is illustrated diagramatically in FIG. 2 which shows a tone generator 20 responsive to actuation of one or more keys 16 to provide a tone corresponding to the key being played. The generator 20 is also connected to the pressure sensitive conroller 14 and operation of the controller modifies the output of the generator 20 and thus speaker 22.

The controller comprises one or more pressure-sensitive pads actuable independently of the keys 16. For purposes of illustration, and in the preferred embodiment, the controller comprises three independent, pressure-sensitive pads, a first of which, **14*a*, (FIG. 1), flattens the pitch of the tone being played; a second of which, 14*b*, adds vibrato to the tone; and a third of which, 14*c***, sharpens the pitch of the note. Thus, a player can quickly add his or her own "modulation" to the tone being played, much in the same manner as he or she would have been able to do with a conventional instrument such as a piano, a violin, etc., and thereby dramatically enhance the musical capabilities of the instrument.

It will be noted from FIG. 1 that the controller is common to all the keys of the keyboard. Thus, only a single pad need be utilized for each parameter to be varied, each pad being operatively connected to vary the response of each of the keys of the keyboard. Further, as will be seen more particularly in connection with the preferred form of controller illustrated in FIGS. 3 through 10 below, the pads are pressure sensitive and thereby provide a range of control effects, in contrast to the limited on-off capabilities of conventional switches. Further, they achieve a broad control range while occupying physically very little space, in contrast to other forms of controllers, are rapidly and repeatedly "locateable", and provide a highly desireable tactile "feel".

Turning now to FIG. 3, a preferred form of pressure sensitive controller in accordance with the present invention is illustrated. The controller is shown as including three pressure-sensitive pads for purposes of illustration, but it will be understood that a greater or lesser number may be used. As shown, the controller comprises an upper housing 30 and a lower board 32. Mating through-holes 34 in the upper housing and lower board accomodate screws which faciliatate joinder of the housing and board together. Mounted on the board 32 are fixed contacts 36 and elongated resistance elements 38 spaced from the contact 36 by gaps 40. Terminal leads 42, 44 are connected to the contact 36 and to the remote end (i.e. the end farthest from the contact 36) of the resistence element 38, respectively.

The upper housing 30 is in the form of a generally rectangular base 50 having defined thereon a plurality of force-application areas ("pads") 52 defined by an elevated plateau 54 delimited by sidewalls 56. The pads 52 and the corresponding portions of the board 32 are identical and thus only a single one of these pads will be further described in detail. As shown in FIGS. 4 through 8, the underside of the pad 52 is configured with a downwardly extending peripheral sidewall 60 enclosing an adjacent inwardly recessed land 62 against which the board 32 butts when mated with the housing. This accurately locates the board 32 with respect to the pads 52. Centrally disposed within the bottom of the housing is a contact strip 64 formed on, or adhered to, an outwardly facing surface 66 of the housing. This surface, and thus the contact strip 64 mounted on it, is inwardly curved starting from a point at the right as seen in FIG. 6. As seen in FIGS. 7 and 8, this point corresponds to the location of the stationery contact 36 mounted on the board 32 when the elements are assembled together, and thus the contact strip 64 is curved away from the resistance element 38 such that the spacing between these elements progressively increases as one progresses from the end of element 38 adjacent to the contact 36 to the end of element 38 remote from this contact.

Tapered channels 70, 72 extend alongside contact 64 from one side of land 62 to the other. These channels modify the force-resistant characteristics of the plateau 52 and provide a diminishing ease of deflection as one progresses from the vicinity of the contact 36 to the vicinity of the remote end of resistance element 38. Similarly, a tapered surface 74 connects the remote end of contact strip 64 to the adjacent land to allow depression of the remote end of the pad and touching of the contact element 64 to the resistance element 38.

The operation of the controller may now be readily understood. In the absence of a force on a pad 54, the contact strip 64 is spaced from the resistance element 38 and an open circuit (infinite resistance) is presented between the terminals 42, 44 of this pad. When, however, (FIG. 8) a force 90 of sufficient magnitude is applied to the pad, the contact strip 34 of the pad makes contact with the corresponding resistance element 38, thereby bridging the gap 40 and shorting out a portion of the resistance element 38, the portion shorted out being dependent on the force that is applied, as well as its point of application.

The contact is in the form of a "rolling" contact, that is, the leading edge 92 (FIG. 8) of the contact element 64 progressively "rolls" along the resistance element 38 as the point of application of force moves farther from the contact 36 or, to a lesser extent, as the contact force applied at a given point increases. All points behind the leading edge remain in contact with the resistance element 38 during the time of application of the force, while all points in front of the leading edge remain out of contact with the resistance element. The effective resistance between the terminals 42 and 44 is thus equal to the sum of the resistance of the shorting element 64 between the terminal 42 and the leading edge 92 and the resistance of the resistance element 38 between the leading edge 92 and the terminal 44. Thus, a smooth variation of resistance between the terminals 42 and 44 is obtained in response to application of force at any point on the pad.

In order to insure that the controller has no effect on the circuit in the absence of any force on one or more of the pads, the shorting element 64 is spaced from the resistance element 38 to present an infinite resistance between the terminals 42, 44 in the absence of any such force. For smooth circuit performance, it is important that the spacing between the shorting element 64 and the resistance element 38 during the open condition be small and consistent from controller to controller so that all instruments built with these controllers will have substantially identical characteristics. In units that we have constructed, we have managed to hold the spacing to approximately 5 mils, with a tolerance of + or −. Normally, this would pose a severe burden on large-scale manufacturing and would require the maintenance of extremely close tolerances on all the component parts of the controller (thereby increasing its cost) or require extensive hand working during and after manufacturing in order to maintain the necessary spacing and tolerances. However, we avoid the need for precise component tolerances or extensive handworking by utilizing the contact element 42 not only as a contact but as a spacing element.

In particular, contact 42 comprises a tab stamped from sheet metal and fastened to the board 32. Also mounted on the board 32 is the resistance element 38 and this element can be formed by conventional printed circuit techniques. The upper surface of contact 42 is in intimate contact with the lower surface of shorting element 64 and provides a controlled and repeatable spacing between the element 64 and the element 38 at points adjacent the contact 42. Thus, without added extra cost, the requisite small and repeatable spacing between the elements 64 and 38 is maintained.

A simple but useful controller circuit utilizing the above-described controller is shown in FIG. 9. For ease of illustration, the resistance element of only a single controller pad is illustrated. The resistance between terminals 42 and 44 is shown illustratively as a variable resistor 100. In the preferred control circuit shown in FIG. 9, it is connected in series with a fixed resistor 102 which has one end thereof attached to ground and its end is connected to a source of control (not shown). This forms a simple ratio circuit in which the output at node 44 is thus a function of the resistance of resistors 100 and 102 and the amplitude (or other desired characterising parameter) of the voltage applied to terminal 42. Diodes 104 and 106 are connected in parallel with each other and extend between a first junction formed by resistors 100 and 102 and a second junction formed by a resistor 108 and an output terminal 110. The resistor 108 provides a path to ground for current through the diodes 104–106. The output at terminal 110 is applied to a tone generator or other element to thereby vary the response of this element to produce the desired musical effect.

The diodes 104, 106 eliminate the initial discontinuity in the controller output which would normally be caused by closure of one of the controller switches 14. Resistors 100 and 102 form a voltage divider. Prior to closure (i.e., prior to contact between the shorting element 64 and the resistance element 38) the resistance of resistor 100 is effectively infinite and the ratio of resistor 102 to the resistor 100 is effectively zero. Immediately on closure, however, the resistance of resistor 100 drops to a finite value and thus the ratio of the resistor 102 to the resistor 100 has a finite, albeit small, value. Thus, the output at the node between these two resistors jumps from essentially a zero value to some finite value and this jump would normally produce a noticeable discontinuity in music played on the instrument. The diodes 104, 106 eliminate this discontinuity by providing a gradual conduction when the initial contact is made and as the contact element 64 "rolls" up the resistance element 38.

Specifically, when the output of the junction between resistors 100 and 102 is less than the forward voltage drop across the diodes 104 or the diodes 106, nearly zero output signal is provided at the output terminal 110. As the voltage at the junction of resistors 100 and 102 rises, the diodes smoothly increase their conduction along an exponential curve which increasingly approximates a straight line as the input voltage to them rises. Thus, the output voltage undergoes a smooth transition from zero voltage to the desired output control voltage.

FIG. 10 is a diagramatic illustration of the relationship between the force applied to a controller pad and the output voltage obtainable at the output terminal 110 in response to this force for three different points of force application, namely, near the bottom of the pad (i.e. near contact 42), curve 112; at the middle of the pad, curve 114; and near the top of the pad (i.e., remote from contact 42), curve 116. From FIG. 10 it will be seen that the response is nearly linear over the initial portion of the range and ultimately "saturates" (i.e., becomes flat); the usable portion of this range is thus in the region designated 118. The sensitivity (slope of the output/force curve) is least near the bottom of the pad and greatest near the top, with intermediate values in between. Thus, a variable sensitivity is provided to the musician who may take advantage of this in his performance.

CONCLUSION

From the foregoing, it will be seen that we have provided an approved controller for an electronic musical instrument. The controller is compact, and thus is readily "located" and operated by a musician. It provides a smoothly varying output in response to various "touch" inputs, and allows the musician to touch different portions of it with different forces to obtain differing senstivities for maximum musical expressiveness. Although constructed to maintain close and precise mechanical tolerances of the various components, it is especially suited to large scale production and requires no critical components or extensive hand fitting. Thus it is simple and economical to construct.

It will be understood that numerous changes may be made in the embodiments shown here without departing from either the spirit or the scope of the invention. For example, the controller is shown in FIG. 9 as incorporated in a simple rationmeter circuit but it may in fact take other forms. For example, instead of providing a variable control voltage as in FIG. 9 it may be incorporated as part of the frequency-determining circuitry of a variable frequency oscillator to provide a signal whose frequency (instead of voltage) is continuously functionally related to the force applied to the controller pad. Or it may be connected to a current source to provide a desired variable voltage.

Further, in the controller pads themselves, the shorting element and the resistance element may be interchanged as shown schematically in FIG. 11 in which the element '64 is now an elongated resistive element incorporated on the underside of the pad 30 as was the corresponding shorting element 64 of FIGS. 4–8, while the element 38 is now an elongated shorting strip (corresponding to the resistance strip 38 of FIGS. 4–8). The contact 44' is now connected to remote end of element 64' instead of he element 38', and the output is taken from between the terminals 42' and 44' as was previously the case with terminals 42, 44. Other modifications may make the pad effectively a variable capacitor but this then requires A-C signals.

Various other changes may be made without departing from either the spirit or the scope of the invention and it will be understood that the foregoing is to be taken as illustrative only and not in a limiting sense, the scope of the invention being defined with particularity in the claims.

Having illustrated and described our invention, we claim:

1. An electromechanical transducer for an electronic musical instrument comprising A. means forming a first electrical contact, B. an elongated resistance element adjacent to, but spaced from, said contact, C. a resilient mounting element (a) having elongated tapered channels at opoosed sides thereof and of a depth increasing from a remote end of said resistance element to a near end thereof for providing increasing yield at positions corresponding to increasing depth in said channels, and (b) including means forming a force-receiving surface on one face thereof and a concave curved surface on an opposed face thereof accommodating a deformable, elongated conductive strip thereon, said strip being electrically connected at one end thereof to said first electrical contact, said strip being (1) aligned with and opposed to said resistance element, (2) mounted to curve away from said resistance element increasingly from said near end in the absence of exterior forces on said strip, and (3) mounted to provide increasing contact with said resistance element starting from said near end thereof in response to exterior forces thereon, to thereby provide a varying resistance between said first contact and the remote end of said resistance element, and said force-receiving surface being elongated with said strip such that the minimum resistance achievable between said first contact and said remote end of said resistance element can be varied by varying the location of the exterior force applied to said force-receiving surface.

2. A transducer according to claim 1 which includes:

(1) a first mounting means for supporting said first contact and said resistance element thereon, (2) said resilient mounting element (a) including means for supporting said strip on said curved surface, (b) configured to position a first end of said strip against said first contact, (c) configured to position the remainder of said strip opposite, but spaced from, said resistance element in the absence of external force thereon, (d) yieldable to contact said resistance element in response to an external force being exerted on said force-applying surface.

3. A transducer according to claim 2 in which (1) said first mounting means comprises a relatively unyielding plate, and (2) said resilient mounting means comprises a resilient casing fixed to said plate and deformable in response to external forces to bridge said strip across said contact and said resistance element.

4. A transducer according to claim 3 in which said casing, when fixed to said plate, firmly butts said first contact against one end of said conductive strip and positions said strip closely adjacent to, but spaced from, said resistance element in the absence of external force on said casing.

5. A transducer according to claim 3 in which said plate comprises a printed circuit board.

6. A transducer according to claim 5 in which said board includes a ratio circuit thereon forming a signal voltage that is a function of the ratio of at least one fixed resistance and the unshorted resistance of said resistance element.

7. A transducer according to claim 3 which includes (1) means electrically connecting said first contact and an end of said resistance element remote therefrom into a series circuit including a signal source and at least one further resistor, (2) means applying the resultant voltage at one junction of said resistor and said resistance elements to at least one diode polarised to conduct in the forward direction with respect to said signal, and (3) means connected to receive the output of said diode.

8. An electronic musical instrument including a transducer according to any of claims 2–7 and a plurality of note-selecting elements, said transducer being connected to said note-selecting elements to modify the outputs of activated ones of said note-selecting elements independently of the number of activated note-selecting elements and in response to the amount of force applied thereto and the location of application of the force along said force-receiving surface.

* * * * *